US009861869B2

(12) United States Patent
Wilkowski

(10) Patent No.: US 9,861,869 B2
(45) Date of Patent: Jan. 9, 2018

(54) UNIVERSAL LIE-BALANCED PUTTER SYSTEM

(71) Applicant: Gery Wilkowski, Hilliard, OH (US)

(72) Inventor: Gery Wilkowski, Hilliard, OH (US)

( * ) Notice: Subject to any disclaimer, the term of this patent is extended or adjusted under 35 U.S.C. 154(b) by 0 days.

(21) Appl. No.: 15/453,752

(22) Filed: Mar. 8, 2017

(65) Prior Publication Data

US 2017/0259139 A1 Sep. 14, 2017

Related U.S. Application Data

(60) Provisional application No. 62/305,267, filed on Mar. 8, 2016.

(51) Int. Cl.
*A63B 53/16* (2006.01)
*A63B 53/14* (2015.01)
*A63B 60/24* (2015.01)

(52) U.S. Cl.
CPC ..... *A63B 53/14* (2013.01); *A63B 60/24* (2015.10)

(58) Field of Classification Search
CPC ..... A63B 53/14; A63B 60/10; A63B 60/24
See application file for complete search history.

(56) References Cited

U.S. PATENT DOCUMENTS 1,611,925 A * 12/1926 Link ..... A63B 53/14 473/298
1,968,616 A * 7/1934 Oldham ..... A63B 53/00 473/298
4,365,807 A * 12/1982 Melby ..... A63B 53/14 473/295
4,826,168 A * 5/1989 McGuire ..... A63B 53/14 473/295
5,390,921 A * 2/1995 De Ruyter ..... A63B 53/14 473/299
5,904,626 A * 5/1999 Fendel ..... A63B 53/14 273/DIG. 23
6,036,607 A * 3/2000 Finegan ..... A63B 53/14 473/206
6,364,787 B1 * 4/2002 Huiskamp ..... A63B 53/14 473/292
6,511,386 B1 * 1/2003 Cacicedo ..... B25G 1/01 473/300
7,635,310 B2 * 12/2009 Keough ..... A63B 53/14 473/297

(Continued)

*Primary Examiner* — Stephen Blau

(57) ABSTRACT

A counter-balance grip system for a golf putter that allows for counter-balancing in the three degrees-of-freedom of relevant putter motion. A main balance-weight body is attached to the end of a putter shaft and allows for axial and radial asymmetric internal balance weighting about the putter shaft. The main balance-weight body has an upper balance-weight body and a lower balance-weight body. The lower balance-weight body is used to achieve the asymmetric internal balance weighting in both a single-grip option and a split-grip option; the upper balance-weight body also being used to achieve the asymmetric internal balance weighting in the split-grip option. Either a plurality of internal balancing weights could be used or the main balance-weight body could be machined asymmetrically. Each of the plurality of internal balancing weights has a different length, mass, and/or density, allowing for the dynamic balancing of the putter.

14 Claims, 18 Drawing Sheets

(56) References Cited

U.S. PATENT DOCUMENTS

| | | | | |
|---|---|---|---|---|
| 8,182,361 | B2 * | 5/2012 | Gill | A63B 53/14 473/299 |
| 8,814,718 | B1 * | 8/2014 | Rollinson | A63B 53/00 473/296 |
| 2003/0084756 | A1 * | 5/2003 | Schroder | B25G 1/01 81/20 |
| 2007/0219015 | A1 * | 9/2007 | Gazeley | A63B 53/007 473/300 |
| 2008/0009363 | A1 * | 1/2008 | Solodovnick | A63B 60/24 473/297 |

* cited by examiner

Moment the golfer must resist in the Z-Y plane:

$$M_{Z-Y} = Wt_{head}*d_{head(y)} + Wt_{shaft}*d_{shaft} + Wt_{grip}*d_{grip}$$

Moment the golfer must resist in the X-Z plane:

$$M_{X-Z} = Wt_{head} * d_{head(x)}$$

Torque the golfer must resist along the $Z_{shaft}$-axis:

$$T_Z = Wt_{head} * d_{head(z)}$$

UNIVERSAL LIE-BALANCED PUTTER SYSTEM

The current application claims a priority to the U.S. Provisional Patent application Ser. No. 62/305,267 filed on Mar. 8, 2016.

FIELD OF THE INVENTION

The present invention relates generally to golf equipment. More specifically, the present invention is a counter-balance grip system for a golf putter that allows for counter-balancing in the three degrees-of-freedom of relevant putter motion and moments/torques at the golfer's grip position that can be applied to any existing or new putter.

BACKGROUND OF THE INVENTION

The game of golf involves striking a golf ball with sufficient force and accuracy to reach the putting green. Typically, up to 13 different clubs are used to do this. On the putting green, only one club is used for hitting the ball in the hole, i.e., the putter. For a golf course rating, par is determined by the number of strokes a "good" golfer would take to complete the hole. If shooting par, half the strokes are putts. Hence the putter is the most important golf club.

The putting stroke is completely different than the golf swing needed to reach the green. Putting requires gentle striking of the golf ball to get it in the hole. Precise control of the direction and distance for putting the ball, as well as the ability to read the green to know where to hit the ball to account for any curvature on the green surface, are the physical aspects of putting. Mental attitude and being comfortable with making the putt are equally important. Putting is frequently thought to be more of an art than science, but numerous technological developments have been made in the recent times to improve all golf equipment, including some putter aspects.

Putters consist of a head, shaft, and grip. The original putter heads were flat or blade-like. Many modern putter heads are much bigger to increase the moment-of-inertial (MOI), so that when impacting the ball, the face the putter head doesn't twist with an off center hit. The MOI development increases the confidence to the golfer as well. Many other developments for putters have been made such as; making a better contact surface on the putter face to get the ball rolling sooner, making the grip larger to give a better feel, etc.

Modern putters with higher MOI heads have greater balancing concerns at the golfer's grip position. When holding the putter in the normal lie-position (the head under the golfer's eyes), these balancing issues cause the large bending moment to the putter perpendicular to the putting direction, torsion of the putter head to twist in the golfer's grip, and a slight moment wanting to twist the putter face to a higher loft. These undesirable moments and torsion require the golfer to subconsciously correct for these loading directions during the putting stroke, masking the feeling of what is essential to make a good putting stroke. Such unbalanced moments/torques and corrections for them can cause the putter head to wobble along the swing path as well as increasing the required grip pressure by the golfer. The better feel from elimination of these undesired moments and torques also improves the mental confidence at the same time.

One of the aspects of putter design that is starting to get attention is the advantage of balancing. Several patents exist for putting small axisymmetric weights (relative to this patent application) in the end of the shaft. That weight moves the center of gravity of the putter very slightly closer to the grip, but the center of gravity along the shaft is still closer to the putter head than where the golfer grips the club. Other patents describe how to eliminate the torsion from the putter head weight, but still leave the main "lifting moment" at the golfer's grip. This patent teaches how to completely eliminate the bending moments in different directions and torsion at the golfer's grip position by adjustable balancing done in the grip so it can be applied to any putter.

The present invention recognizes that there are three relevant degrees-of-freedom of putter motion and corresponding moments and torques for complete balancing at the centroid of the golfer's grip when the putter is held in the normal lie-position (under the golfer's eyes). The present invention provides an offset or nonsymmetrical, adjustable balancing weight system that is concentrated at the upper part of the grip that follows all United States Golf Association (USGA) grip requirements (described later). Counter balancing of a modern high-moment-of-inertia (MOI) putter requires a significant mass above the golfer's grip position that cannot be accomplished with a weight inside the shaft (even if depleted uranium or gold was used). Modern high MOI putter heads have a much larger mass than the original blade putters of early golf. The higher mass provided by the present invention controls three detrimental aspects to the golfer's ability to "feel" the putt by creating; (a) a bending, or lifting, moment in the plane perpendicular to the putting direction to counteract the putter head weight, (b) a bending, or loft-increasing, moment that wants to counteract the increase of loft of the putter face that comes from the center of mass of the putter head being behind the shaft, and (c) a torque at the grip position to counteract the torsion induced from the putter head wanting to twist under the shaft.

The "feel" of the putter is affected by the following aspects: (i) The actual gravity or dead-weight of the putter—that's unchangeable; (ii) The force required swinging the putter as desired—that is the force you want to be the largest percentage of the forces/moments that the golfer's hand "feel"; (iii) The moment/force required by the golfer to lift the putter to the lie position under his eyes (also called the "lifting moment"). The putter might be at approximately a 70-degree angle, but that is variable with putter design and the golfer's preferences. This is the largest nonessential moment/torque/force the golfer feels and is the primary balance axis of the proposed balancing system. Many patents talk about balancing in this direction, but not to the magnitude needed for high MOI putters and having it adjustable to the centroid of the golfer's grip position; (iv) In the lie-position under the golfer's eyes (~70-degree shaft angle from the ground), virtually all modern putters will twist into an open position (also called the "head torque"). The hands of the golfer need to twist the putter face back to the square position. This torque adds additional forces on the golfer's hands that further mask the "feel" of the putt forces that are need to strike the ball. There is an internal offset mass in the proposed balancing weight that is adjustable to counteract the torsion that is imposed on the golfer's hands when the putter is in the lie-position. In the preferred application there are a series of holes where different size weights can be inserted to provide the face-balancing compensation for the lie-position depending on the putter design and where the golfer grips the club; (v) The offset centroid of the putter head also creates a smaller moment that wants to increase the loft of the putter face (called the "loft-increasing moment"). This increased loft is undesirable since it makes the ball bounce rather than roll after initial impact.

Although the location of the main balance-weight body provided by the present invention is adjustable, the main balance-weight body within the grip must be locked into place to maintain the balance position. The balancing in the three degrees-of-freedom of motion can be accomplished in either a split-grip option or single grip option, although some details differ with the two options, the basic principle is identical. During the initial fit-up with the split-grip option, set screws are used to adjust the upper balance-weight body up and down the shaft to do the primary putter "lifting-moment" balancing described in (iii) above. The length of the main balance-weight body consists of two pieces in a split-grip option, typically using a shorter aluminum or stainless steel piece for the bottom with an upper stainless steel section. (The material used for this lower section may vary with the weight of the putter head, and similarly a higher density material could be used for the upper part). The lower balance-weight body is locked in at the lifting-moment balance location. The heavier stainless steel part on the top can then be rotated so the symmetric position of a set of internal offset holes is lined up with the centroid of the mass of the putter head.

If there is too much torque-balancing correction without filling the internal offset holes, then rods of different lengths and density are inserted into the internal offset holes to change the offsetting mass. These rods must be locked in place with an adhesive when the balancing is completed. If more torsional offset is needed, then offset holes in the lower balance-weight body are filled with different masses for additional torsion balancing. If the moment (causing the face to have more loft) exists after the torque-balancing operation, then the inserted weights and rotation of the upper balance-weight body can be adjusted so that the loft-increasing moment and torque balancing are both accomplished. If possible, the loft-increasing-moment is desired to be reversed and not balanced, since the negative face loft is more desirable to get the golf ball rolling sooner. The axial location of the main balance-weight body may need adjusting if the torque balancing with the additional internal weights changes the total weight; hence some iteration is needed between the axial weight position/magnitude and the location and amount of the inserted asymmetric balance weights. Once the whole balancing process is completed for the split-grip option, an adhesive is used between the shaft and upper grip parts to lock everything in place. After the adhesive is cured, then an external "skin" is applied over the upper metal grip. By USGA Rules the outside diameter of the upper grip with the cover needs to be less than 1.75 inch. In a split-grip application, by USGA Rules the total length of the putter needs to be greater than 38.5 inches, so that the distance between the actual grip and the weighted section can be a small as 1.5 inches. Additionally, by USGA Rules, the length of the weighted upper grip must be greater than 5.0 inches; and the external cross-section of the weighted section is circular in the split-grip option. For practicality, the putter length for the split-grip option is made just slightly larger than 38.5-inches, the gap between the main balance-weight body and the lower actual grip is made just slightly larger than 1.5 inches, and the main balance-weight body is slightly larger than 5.0 inches.

The above counterbalancing system can be designed to be a one-piece grip if desired to keep the total putter length less than 38.5-inches (for shorter golfers) or for aesthetic purposes. In this case the weighted section is abutted to the main grip with a cover over the whole main grip and either part or all of the main balance-weight body. The cross-section of the main balance-weight body and grip section in this option can have a flat region along the axial length of the grip and the main balance-weight body. The maximum diameter again is 1.75-inches, but the length of the main balance-weight body is not restricted. Again the internal offset weights are used to allow for balancing in all three degrees-of-freedom of motion and elimination of the undesired moments and torques. Finally, if a golfer insists on having more weight (moment in the Y-Z plane, as described later), then he can grip above the balance point. The balance point can be also be intentionally made further below the grip while still maintaining the torsional balancing and the eliminating or reversing the loft-increasing moment (X-Z plane moment, as described later).

For custom balancing an individual putter, weights of different lengths or density are judicially placed in internal holes in the main balance weigh body. Alternatively, for manufacturing a larger number of identical putters, the main balance-weight body could have holes of different dimensions so that no weights need to be inserted. In this way, the putters are balanced to pre-set standards as opposed to the individual golfer.

DETAIL DESCRIPTIONS OF THE INVENTION

All illustrations of the drawings are for the purpose of describing selected versions of the present invention and are not intended to limit the scope of the present invention.

The present invention is a counter-balance system within a golf grip for a golf putter that allows for counter-balancing in the three degrees-of-freedom of relevant putter motion, with adjustability so that the present invention can work for any putter design or golfer's grip location. Further, the present invention allows for the elimination of the corresponding undesirable moments/torques at the golfer's grip position. The present invention is designed to balance the weight of the putter at the centroid of the golfer's grip, when the putter is held in the "lie-position" (under the golfer's eyes). This balancing eliminates the putter's lifting moment in the plane perpendicular to the putting direction, loft-increasing moment in the direction of the putt, and torque that exists from the center of gravity of the putter head not being in the plane perpendicular to the putting direction.

Figure 15A:
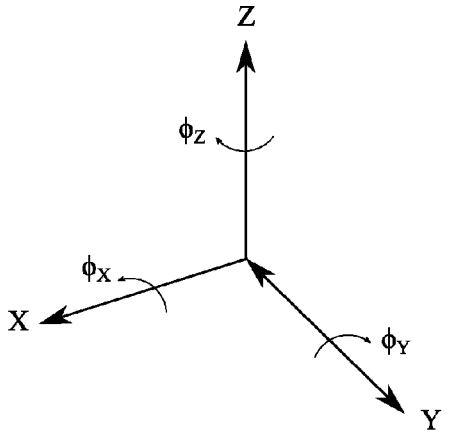
FIG. 15A is a diagram of the six degrees-of-freedom.
Figure 15B:
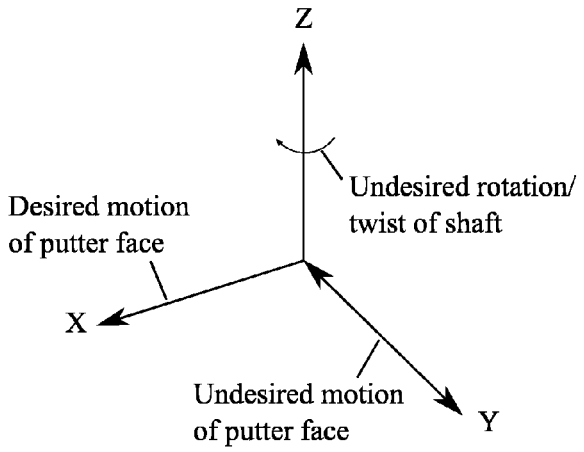
FIG. 15B is a diagram of the three degrees-of-freedom relative to putter motion when striking the ball, wherein the putter shaft is normal to the putting surface.

To teach the complete balancing needed for a putter, it is first necessary to understand the physics of motion to determine the orientations of the resulting forces, moments, and torsion needed for complete balancing. The degrees-of-freedom of motion are spatial (X, Y, and Z using Cartesian coordinates) as well as rotational about those three axes that are at 90 degrees from each other, as depicted in FIG. 15A. When moving a putter head to contact the ball, the motions are generally in a plane parallel to the surface of the putting green; hence these are two spatial degrees-of-freedom for the ball motion. Starting with an idealization that the putter shaft 6 is perpendicular to the plane of the green, there is another degree of freedom that is the rotation of the shaft of the putter. As such, the three relevant degrees-of-freedom of motion for idealized putter head motion when contacting the ball are movement along the X-axis and Y-axis in the X-Y plane (parallel to the surface of the green), and rotation of the putter head/shaft about the Z-axis, as depicted in FIG. 15B.

Figure 15C:
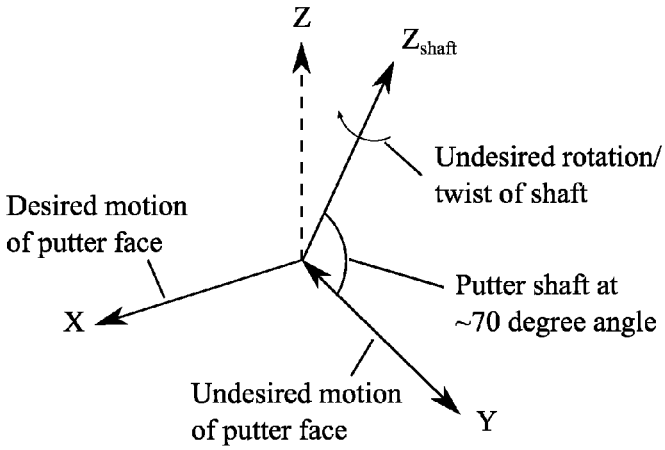
FIG. 15C is a diagram of the three degrees-of-freedom relative to putter motion when striking the ball, wherein the putter shaft is angled with respect to the putting surface.

However, one reality of putting is that the axis of the putter shaft 6 is not perpendicular to the plane of the green, but is angled typically about 70 degrees (±10 degrees), as depicted in FIG. 15C, to accommodate the golfer being on the side of the putting direction as per United States Golf Association (USGA) rules of playing golf. The angle of the putter shaft 6 varies with different manufacturers, golfer's personal desires, and the golfer's physical characteristics but is typically about 70 degrees.

In determining the forces, moments, and torsion that the golfer needs to exert to putt the golf ball, the next aspect to include is the weight of the parts of a putter relative to the coordinate system described above. The putter includes a putter head, a putter shaft 6, and a grip. The putter head is at the end of the putter shaft 6 and frequently has the largest weight. The putter shaft 6 and the putter grip have some additional weight, but typically much less than the putter head; this is due in part because modern putters are frequently made to have higher moment-of-inertia (MOI) heads, with more weight further from the contact point on the putter head, to make the putter head more stable from twisting due to an off-center ball strike. The centroid of a high MOI putter head is frequently further from the Z-Y plane of the shaft, which induces additional moments and torques at the golfer's grip when holding the putter in the normal lie-position (putter head under the golfer's eyes).

For decades now, many putters have been made to be "face-balanced" which was touted to be the proper way to make a putter. "Face-balancing" means that when holding the putter horizontally to find the balance position of the whole club, the face will point upwards. When holding a face-balanced putter vertically from the end of the putter grip, the face would then turn and point in the direction of the putt. However, when holding the face-balanced putter in the proper lie-position (with the center of the putter head under the golfer's eyes at the ~70 degree angle), the face-balance putter wants to twist open. This is a basic torsional balance problem when attempting to make a putt.

Figure 16:
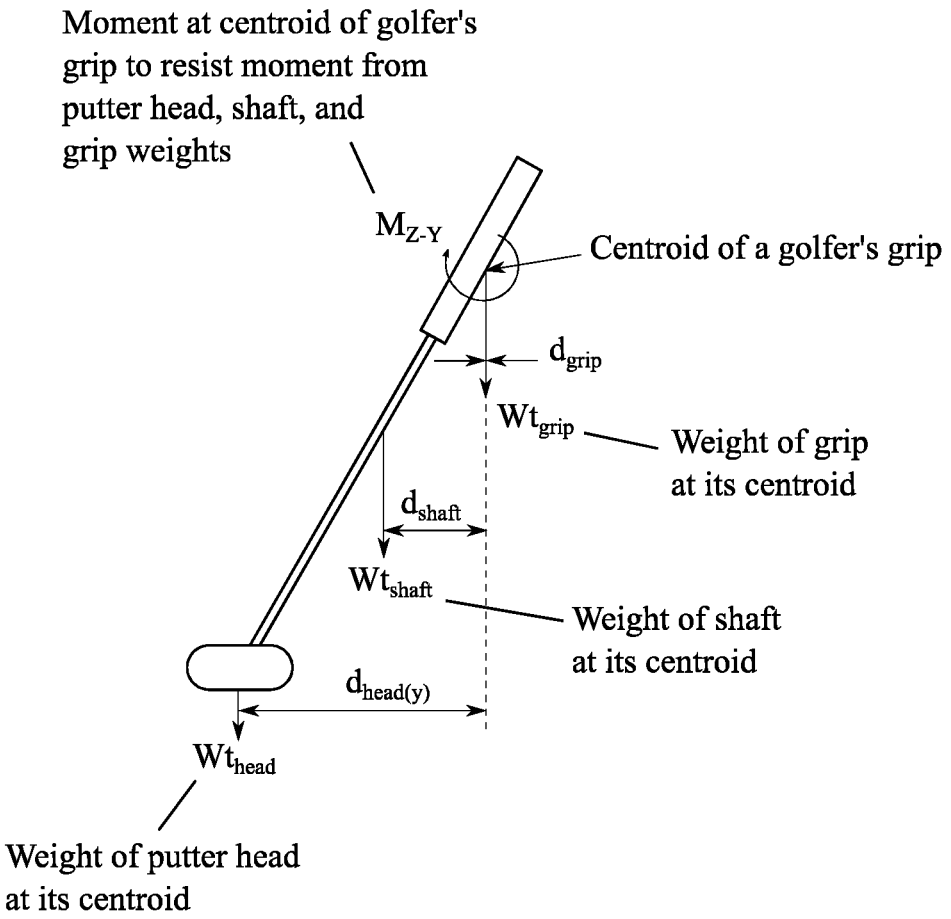
FIG. 16 is a diagram depicting the moment in the Z-Y plane, at the centroid of the golfer's grip, that must be balanced.

In reference to FIG. 16, the largest balancing requirement comes from the moment in the Z-Y plane. It is also important to note that when a golfer grips a club, the golfer's hands can encompass a large percentage of the putter grip; however, there is a centroid of the golfer's grip that is the important balance point. Of course there are a large number of ways to grip a putter, as well as positions along the length of the putter grip, but there is always a centroid of the grip pressure, which is the adjustability aspect addressed by the present invention.

Because the angle of the putter shaft 6 is about 70 degrees from the surface of the green (from Y-axis to Z-axis as depicted in FIG. 15C), unique forces, moments, and torsion are exerted at the centroid of the grip of the golfer. Each of the three components of the putter has its own weight and center of gravity. The resulting forces from an engineering free-body diagram at the grip position are the total weight of the club downward as well as a resisting moment in the Z-Y plane.

Figure 17:
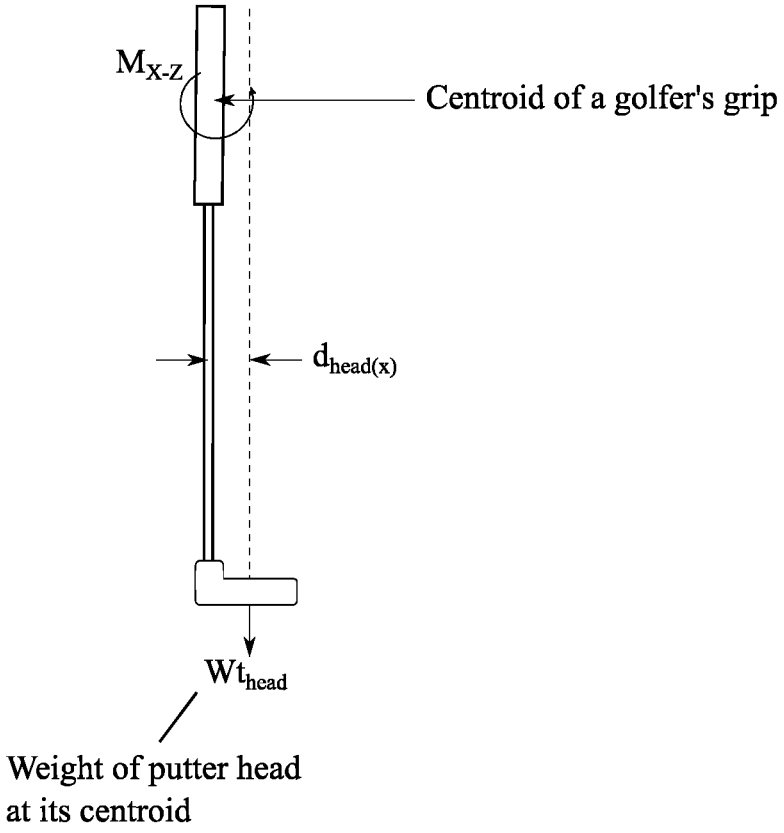
FIG. 17 is a diagram depicting the moment in the X-Z plane, at the centroid of the golfer's grip, that must be balanced to prevent increased loft of the putter face.
Figure 18:
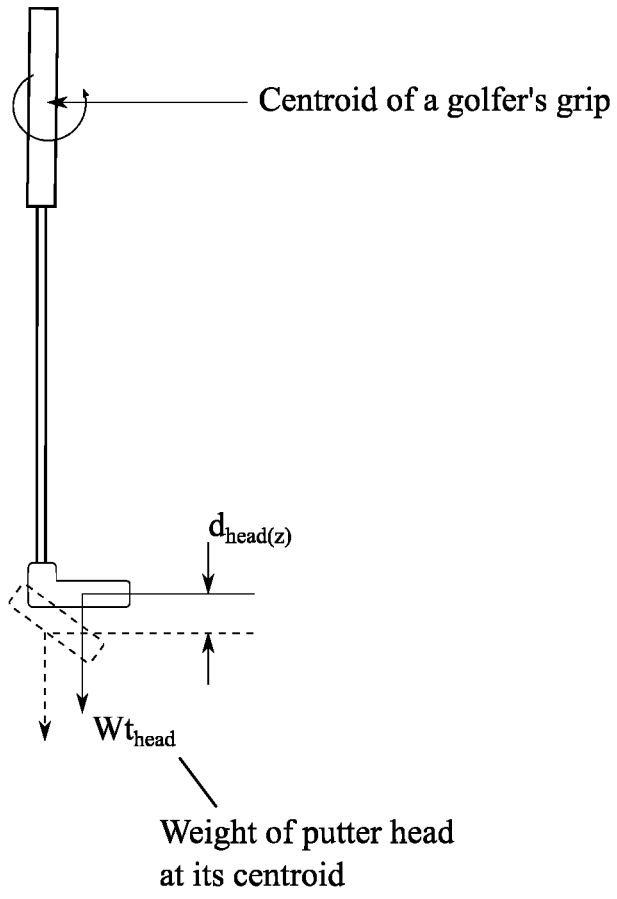
FIG. 18 is a diagram depicting the putter in the X-Z plane, showing the torque that must be overcome to prevent the putter head from twisting to the lowest gravitational position.

In reference to FIG. 17, newer putters have high MOI designs, wherein the putter head extends backwards much farther from the putter shaft 6. The result is a larger head weight and larger offset distance, inducing another moment in the X-Z plane that the golfer needs to compensate for. This moment is usually the smallest for balancing concerns, but causes the loft of the putter face to increase which is undesirable since it causes the golf ball to bounce rather than roll immediately after being struck. Again the total downward weight of the putter needs to be supported by the golfer's grip. Further, the mass of the putter head wants to drop to its lowest gravitational position in line with the putter shaft 6 as depicted in FIG. 18; in many cases, the weight of the putter head wants to twist the club-face open, giving torsion at the golfer's grip that needs to be overcome.

The actual motion of a putter swing can vary from golfer to golfer. For instance, there can be a straight back-and-forth motion of the head toward the target, or a pivoting rotation or arcing head-path of the putter head motion in the X-Y plane. Most golfers have some arc-path in their swings, especially for longer putts; and the putter head also arcs upwards from the putting plane before and after contacting the ball (in the X-Z plane, not illustrated). These arc paths further exasperate the balancing moments and torques at the centroid of the golfer's grip during the putting stroke, since the moments and torques are changing during the putting swing, meaning the golfer needs to compensate dynamically during the putting stroke. These various undesirable moments and torques, and the changes during a swing, require significant unconscious mental compensation by the golfer to perform the motions needed to make a successful swing. From an engineering automatic control analysis, those undesirable moments and torques need to be zeroed out for better control, which is what the present invention achieves.

The present invention is designed to alleviate the aforementioned issues and can be retrofitted to existing putters or integrated into a new putter at the time of manufacture. Furthermore, the present invention can be configured in a single-grip option or a split-grip option, where the basic principles are the same; the single-grip option being the preferred embodiment of the present invention. For both the single-grip option and the split-grip option, the present invention comprises a main balance-weight body 1, a plurality of internal balancing weights 8, a plurality of slots 20 in the main balance-weight body 1, and a shaft receiving channel 30. Each of the plurality of slots 20 traverses into the main balance-weight body 1, wherein the plurality of slots 20 retains selected internal balance weights from the plurality of internal balancing weights 8. The plurality of internal balancing weights 8 includes a variety of weights having various masses and/or densities, which allows for the nonsymmetrical weight distribution required for balancing. Additionally, each of the selected internal balance weights is offset from each other by the plurality of slots 20 to further achieve the nonsymmetrical weight distribution.

The main balance-weight body 1 is cylindrical in shape and provides the main weight used to counter-balance the putter for the "lifting moment". The main balance-weight body 1 comprises a lower balance-weight body 10 and an upper balance-weight body 16; the lower balance-weight body 10 has a first terminal end 11 (the top) and a second terminal end 12 (the bottom). In the split-grip option the putter shaft 6 extends through the main balance-weight body 1 to within 1-inch of the end of the grip. The plurality of slots 20 traverses into the lower balance-weight body 10 through the first terminal end 11, while the shaft receiving channel 30 traverses into the lower balance-weight body 10 through the second terminal end 12. The shaft receiving channel 30 allows the main balance-weight body 1 to be mounted onto the putter shaft 6 opposite the putter head, wherein the putter shaft 6 is positioned into the shaft receiving channel 30. The additional mass above the user's grip increases the polar moment of inertia, making the dynamic putter motion even more stable during the swing. The shaft receiving channel 30 is concentric with the lower balance-weight body 10, which ensures the main balance-weight body 1 is concentrically aligned with the putter shaft 6 when mounted. The putter shaft 6 must end within 1 inch of the end of the grip; for the single-grip option, this is achieved with the use of a shaft extender 70. The plurality of slots 20 traverses into the lower balance-weight body 10 opposite the shaft receiving channel 30, which allows the plurality of internal balancing weights 8 to be inserted into the plurality of slots 20 once the lower balance-weight body 10 has been mounted to the putter shaft 6.

Figure 1:
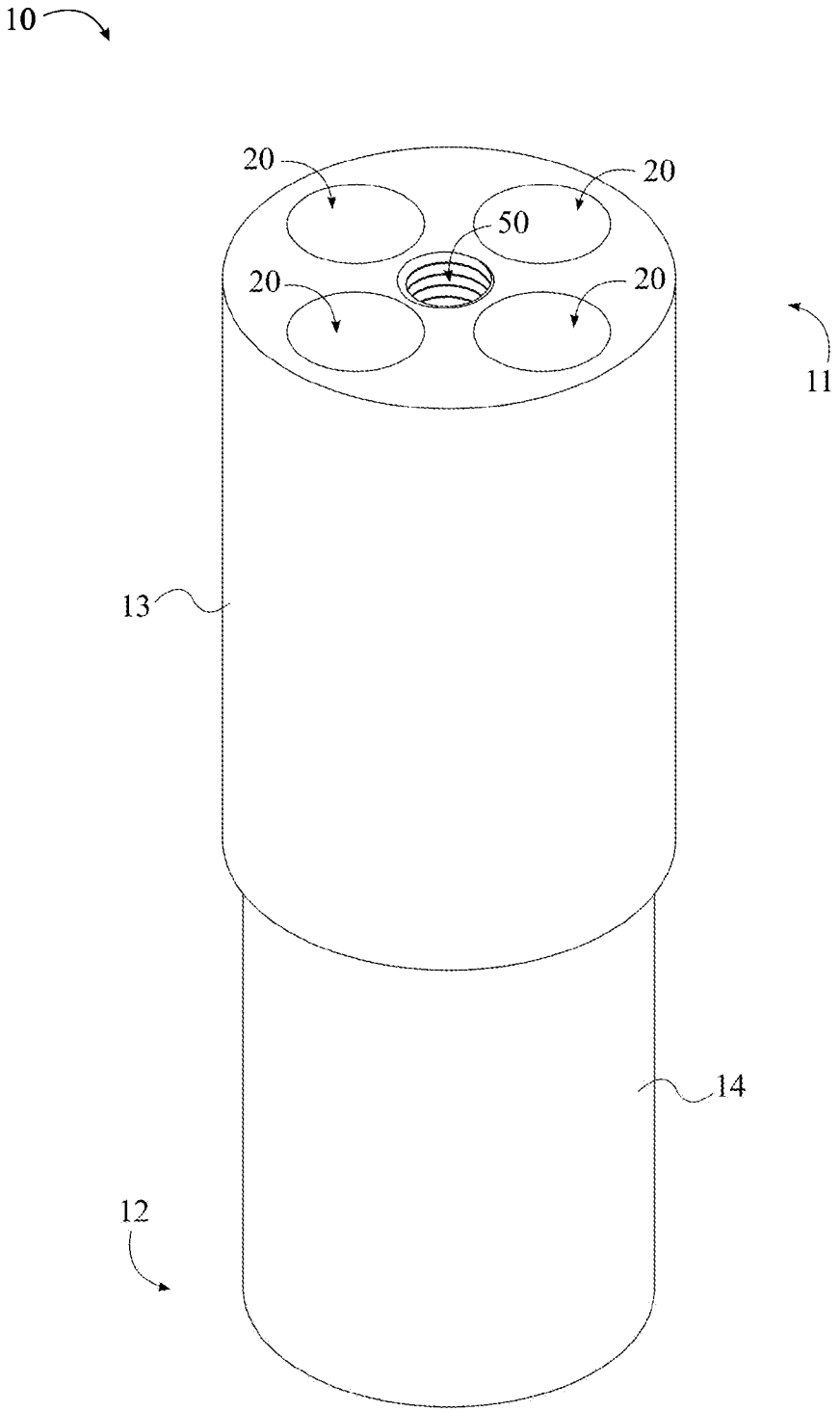
FIG. 1 is a top perspective view of the lower balance-weight body in the single-grip option.
Figure 2:
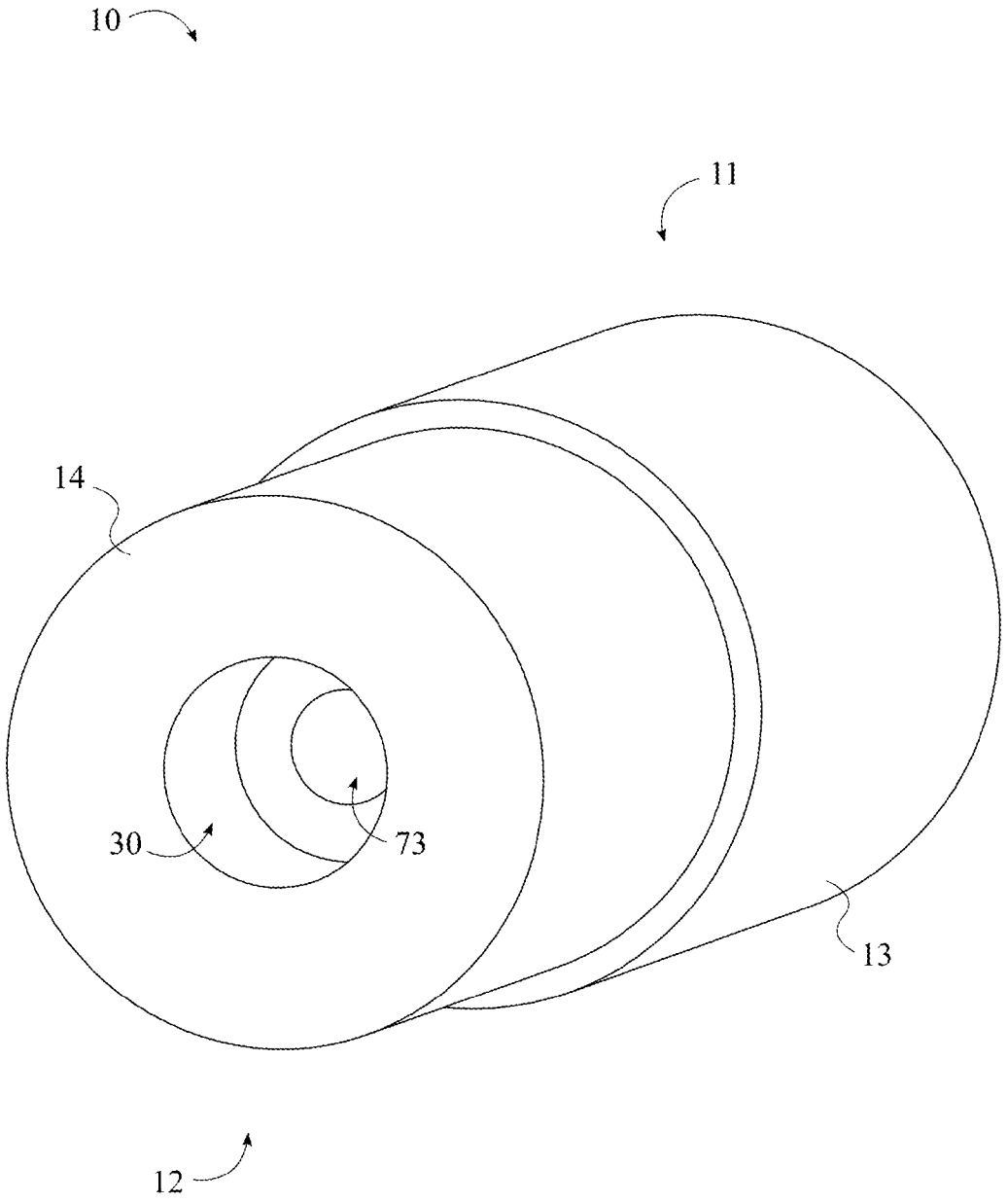
FIG. 2 is a bottom perspective view of the lower balance-weight body in the single-grip option.
Figure 3:
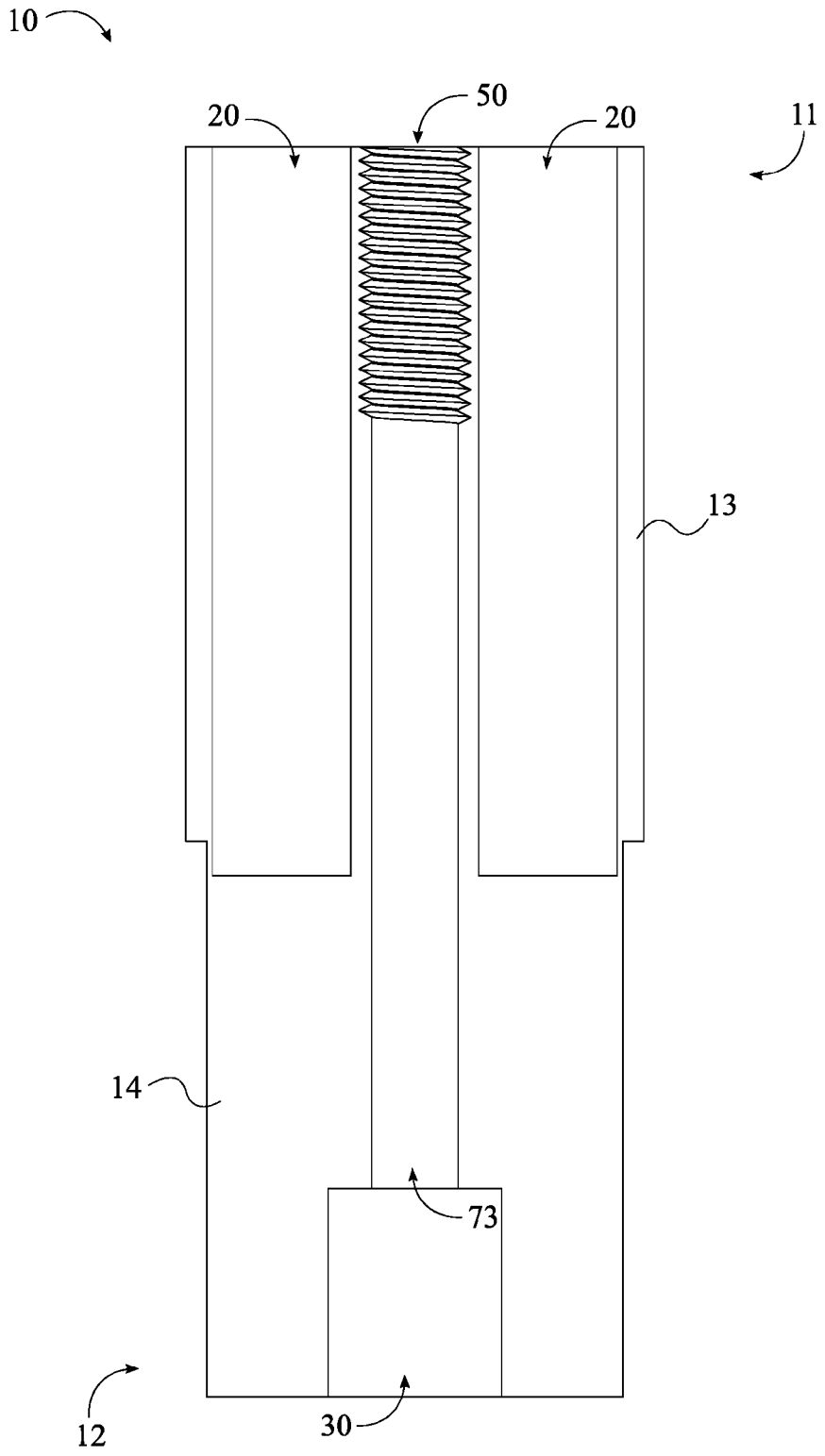
FIG. 3 is a sectional view of the lower balance-weight body in the single-grip option.

In reference to FIG. 1, the preferred embodiment of the present invention is the single-grip option, where the lower balance-weight body 10 comprises an upper body section 13 and a lower body section 14; the lower body section 14 having a diameter that is smaller than a diameter of the upper body section 13. The plurality of slots 20 traverses into the upper body section 13 and the lower body section 14 as depicted in FIG. 3, while the shaft receiving channel 30 traverses into the lower body section 14 as depicted in FIG. 2-3. In reference to FIG. 6-7, the diameter of the lower body section 14 being smaller than the diameter of the upper body section 13 allows a grip cover 4 to encase the lower body section 14, wherein the outer surface of the grip cover 4 is flush with the outer surface of the upper body section 13. To mount the main balance-weight body 1, the putter shaft 6 is positioned into the putter receiving channel and is secured in place by an adhesive bond or other suitable means. The grip cover 4 is then fitted around the lower body section 14, concealing the connection between the putter shaft 6 and the lower balance-weight body 10 and providing a sleek outer profile of the putter, wherein the upper body section 13 blends into the grip cover 4. The grip cover 4 provides the main grip surface for the putter.

Figure 5:
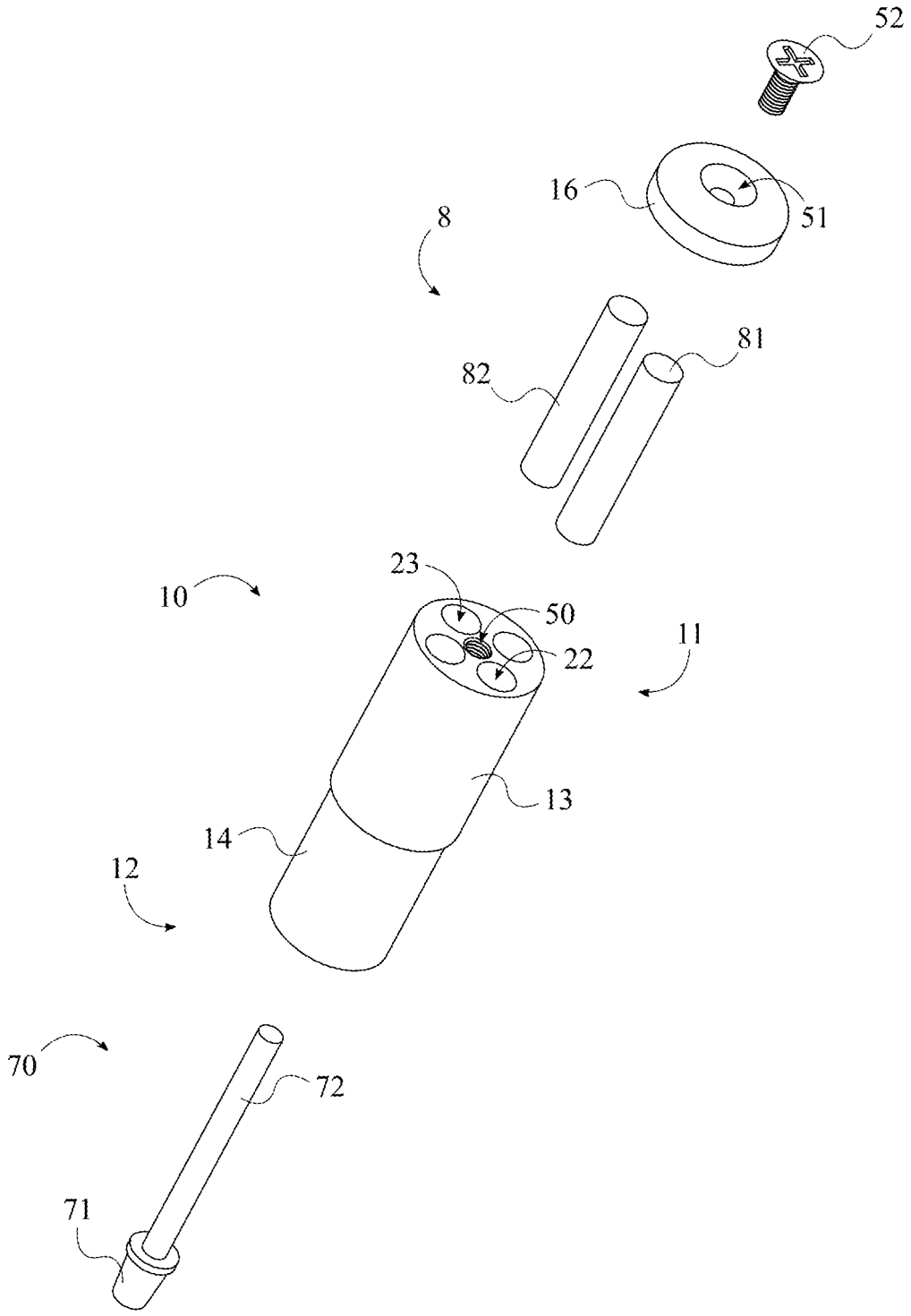
FIG. 5 is an exploded view of the main balance-weight body, the shaft extender, and the plurality of internal balancing weights in the single-grip option.
Figure 6:
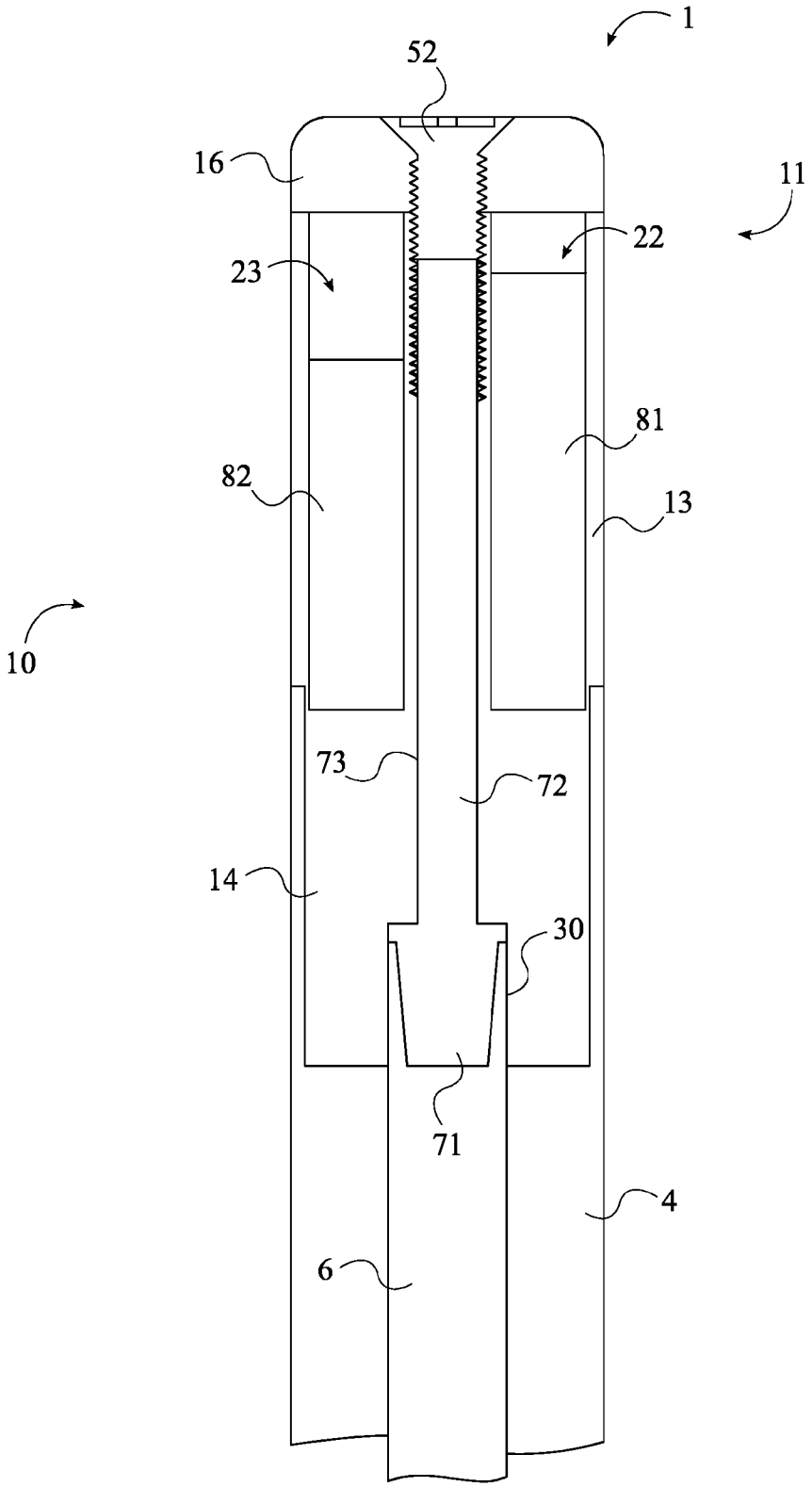
FIG. 6 is a sectional view depicting the shaft extender being positioned within the main balance-weight body, a putter shaft being positioned into the shaft receiving channel and connected to the shaft extender, and a grip cover being positioned about the lower balance-weight body.
Figure 7:
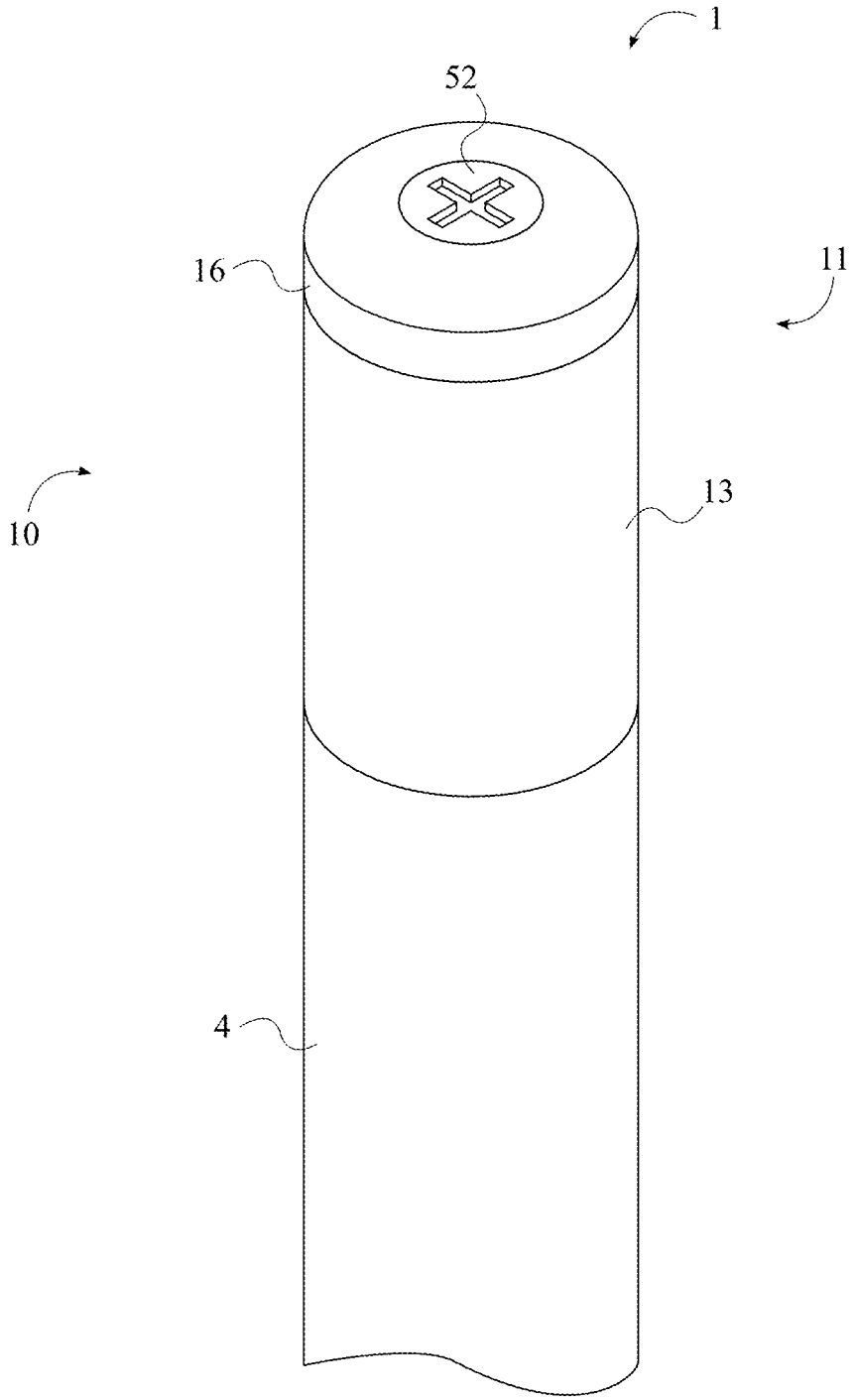
FIG. 7 is a perspective view depicting the grip cover being positioned about the lower body section of the lower balance-weight body, and being positioned flush with the upper body section of the lower balance-weight body.

In reference to FIG. 5-6, the present invention, in the single-grip option, may further comprise the shaft extender 70 and an extender channel 73 that are utilized to further secure the main balance-weight body 1 to the putter shaft 6. The extender channel 73 concentrically traverses into the lower balance-weight body 10, from the shaft receiving channel 30, wherein the extender channel 73 provides a means for receiving a portion of the shaft extender 70; the shaft extender 70 being positioned within the extender channel 73 and the shaft receiving channel 30. The extender channel 73 is narrower than the shaft receiving channel 30, such that a lip is formed preventing the shaft extender 70 from fully entering the extender channel 73. When the putter shaft 6 is positioned into the shaft receiving channel 30, the shaft extender 70 is positioned into the putter shaft 6, wherein the shaft extender 70 provides an additional connection between the putter shaft 6 and the main balance-weight body 1 and terminates within 1 inch of the end of the grip.

In further reference to FIG. 5-6, the shaft extender 70 comprises a tapered end 71 and a rod 72; the rod 72 being terminally connected to the tapered end 71. The tapered end 71 is positioned within the shaft receiving channel 30, while the rod 72 is positioned within the extender channel 73. The tapered end 71 rests on the lip formed by the extender channel 73 and the shaft receiving channel 30, and is tapers away from the rod 72. When the putter shaft 6 is positioned into the shaft receiving channel 30, the tapered end 71 is positioned into the putter shaft 6. The tapered end 71 is secured to the putter shaft 6 using epoxy or another suitable means. Additionally, the putter shaft 6 is epoxied, or otherwise secured, to the lower body 14. The rod 72 may similarly be epoxied to the lower balance-weight body 10, or secured to the lower balance-weight body 10 by another similar means.

Figure 4:
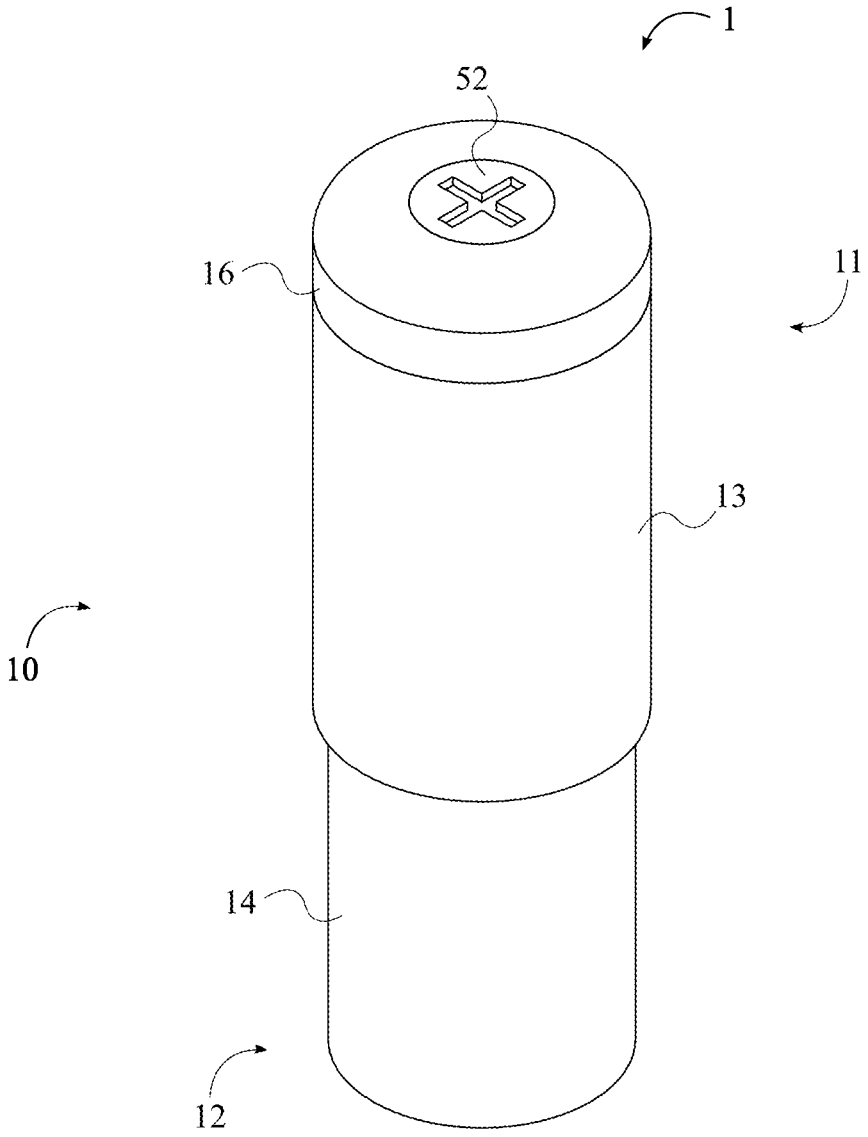
FIG. 4 is a perspective view of the main balance-weight body in the single-grip option; the upper balance-weight body being secured to the lower balance-weight body.

In reference to FIG. 4, the upper balance-weight body 16 is attached to the first terminal end 11, and is concentric with the lower balance-weight body 10. The upper balance-weight body 16 is used to allow insertion, and retention, of the selected internal balance weights within the plurality of slots 20 during the balancing operation. In the preferred embodiment of the present invention, the upper balance-weight body 16 is secured to the lower balance-weight body 10 by means of a threaded channel 50, a screw hole 51, and a lock screw 52 as depicted in FIG. 5-6. The threaded channel 50 concentrically traverses into the first terminal end 11 of the lower balance-weight body 10. Meanwhile, the screw hole 51 concentrically traverses through the upper balance-weight body 16; the screw hole 51 being concentrically aligned with the threaded channel 50 when the upper balance-weight body 16 is positioned onto the lower balance-weight body 10. The lock screw 52 is positioned through the screw hole 51 and into the threaded channel 50, wherein the lock screw 52 engages the threaded channel 50 to secure the upper balance-weight body 16 to the lower balance-weight body 10.

While the main balance-weight body 1 provides the main weight for counter-balancing the putter for the lifting moment, the plurality of slots 20 and the plurality of internal balancing weights 8 are used together to fine tune the balancing of the putter for balancing of the torsional and loft-increasing moment, and provide flexibility in the balancing. This is critical in the design of the present invention because each putter design and each golfer's grip position can be different; thus, the total mass and location of the selected internal balance weights in the plurality of slots 20 will vary from user to user. Golfers can grip the putter in a variety of locations depending on their physique and what "feels comfortable to them". For instance, a tall golfer needs to have a more upright putter to keep the putter head under his eyes and typically grips the club further from the putter head. Additionally, some golfers may bend over the ball more or less, depending on their comfort level which affects the location of their grip. The adjustability of the present invention is accomplished by varying the axial distance of the main balance-weight body 1 and the selected internal balance weights above the centroid of the golfer's grip, as well as the axial length of each of the selected internal balance weights and the density of the material used to make each of the selected internal balance weights. Lower density spacer weights can be inserted into the holes first so that the higher mass internal weights can fine-tune the balancing operation.

The axial distance, the axial length, and the density of each of the selected internal balance weights depends on the amount of mass needed to balance the putter head weight, the mass of the shaft below the grip, the shaft angle, and location of the centroid of the grip pressure. The balancing is done so that when the putter head is located directly below the golfer's eyes (in the lie position), the balance point is at the centroid of the grip pressure of the golfer. The present invention provides the large mass, terminally positioned about the putter shaft 6 that is needed for the complete balancing of the putter, which significantly increases the polar moment of inertia, making the putting stroke dynamically more stable and hence much smoother. The putter's weight-induced lifting moment in the plane perpendicular to the putting line that is felt in the golfer's grip, the loft increasing moment in the plane towards the putting direction, and the torque from the putter head's offset center of gravity is eliminated by this adjustable balancing. This complete balancing allows the grip pressure to be drastically reduced by a factor of more than three, giving an incredible increase in the feel of the putting motion needed. The relaxed grip is also helpful to golfers that have difficulty with the "yips" that are typically cause by gripping the putter too tightly.

The correct balance is found for each user through minor iterations, or trial and error, as balancing the putter in one direction affects the balancing in the other direction (e.g., if the torque balancing increases a weight, then the main weight needs to be moved axially, to be retargeted to the centroid of the golfer's grip position). However, this torque balancing also needs to be accomplished with the putter in the lie position and at the golfer's centroid of grip pressure. Internal weights, having different lengths and densities, are selected one by one from the plurality of internal balancing weights 8 and inserted into selected slots from the plurality of slots 20. The golfer, or a custom fitter who has a good feel for the balancing operation, performs the putting motion for each iteration until the ideal balancing is achieved. Alternatively, the balancing operation can be performed by a device that clamps to the target balance position and allows for X-Z and Y-Z planar motions as well as torque about the putter shaft 6.

The following is an exemplary iteration for balancing the putter. A first internal weight 81 is selected from the plurality of internal balancing weights 8 and positioned into a specific slot 22 from the plurality of slots 20 in the main balance-weight body 1. The upper balance-weight body 16 is then secured to the lower balance-weight body 10, and the golfer or fitter performs a putting motion one or more times. The lie-balance position is targeted to the location of the centroid of the grip of the golfer. The first internal weight 81 is then either left in the specific slot 22 if the balance point reached the target grip location, moved to a different slot from the plurality of slots 20, or removed completely. A second internal weight 82 is then selected from the plurality of internal balancing weights 8 and positioned into a subsequent slot 23 from the plurality of slots 20 in the main balance-weight body 1. Again, the upper balance-weight body 16 is secured to the lower balance-weight body 10, and the golfer or fitter performs the putting motion one or more times. The second internal weight 82 is then either left in the subsequent slot 23 if the target balance point is achieved at the centroid of the grip position of the golfer, moved to another slot from the plurality of slots 20, or removed completely. Additional internal weights are then added and removed until the desired balance location is achieved at the targeted centroidal grip location. This procedure is first done for the "lifting-moment" balancing that changes the balance location axially along the putter shaft, then the torsional balancing is done so that the putter does not want to twist at the balance location, and finally the loft-increasing moment balancing is done so the putter face wants to lean backwards (loft decreasing moment is induced). Some iteration is needed between the different balancing steps. Once the balancing operation is completed, each of the selected internal balance weights is adhesively bonded to the main balance-weight body 1.

In reference to FIG. 1, to allow for the proper balancing of the putter, each of the plurality of slots 20 is offset from each other. In the preferred embodiment of the present invention, the plurality of slots 20 is radially dispersed about the lower balance-weight body 10; more specifically, the plurality of slots 20 is radially dispersed about the threaded channel 50. Each of the plurality of internal balancing weights 8 is a rod of different length and/or density, wherein the plurality of internal balancing weights 8 is used to fill the plurality of slots 20 until the proper torque-balancing is accomplished and the loft-increasing moment is eliminated. The shorter length high-density rods can also be located anywhere along the axial length of the plurality of slots 20 by using lower density inserts as spacers, thereby giving an additional balance fine-tuning option. The internal position of the plurality of internal balancing weights 8 allows the external geometry to maintain a perfect circular cross-section if desired. It is also possible to have a flat surface along the axial length of the grip if desired, so the cross-section may not be perfectly circular. The total mass of the selected internal balance weights can be as much as 70-percent of the overall mass of the present invention for a high MOI putter head, but could go to 0 for an old-fashion thin blade putter.

Once the balancing at the centroid of the golfer's grip pressure is accomplished, only the gravitational weight is felt at the golfer's grip. For the putters modified to date, this reduction of the lifting moment and torque enables the golfer to relax his grip pressure by a factor of 3 to 7. The relaxed grip gives a greatly improved feel for the putting force needed that is critical for short putts or putting on fast greens. Since accuracy is increased for shorter putts, there will also be fewer 3-putt greens. Additionally, the reduced grip pressure is beneficial for eliminating "yips" that are frequently caused by a grip that is too strong. Furthermore, the higher mass above the grip significantly increases the polar moment of inertia of the whole club, hence increasing the dynamic stability of the putter motion. The golfer only needs to start the putting motion in the direction of interest with the proper velocity, and the putter will stay on track better, even with the much more relaxed grip pressure. The improvements make a significant step change in the ability to make short putts and putt on fast greens, thereby increasing the golfer's confidence.

Once the putter has been properly balanced, a grip indicator is marked on the grip cover 4. The grip indicator directs the golfer where to grasp the grip cover 4 in order to ensure the putter is properly balanced throughout the swing, each time the golfer uses the putter. In the preferred embodiment of the present invention, a plurality of circumferential lines runs along the grip cover 4, wherein the grip indicator is a color mark around one of the circumferential lines. If the golfer insists on feeling more of the moment in the Y-Z plane, then the golfer can grip the putter above the grip indicator. Alternatively, the grip indicator for the perfect balance location could be set below the golfer's centroid grip position while still using the selected internal balance weights to eliminate the torsion and eliminate the moment that increases the putter loft.

Figure 9:
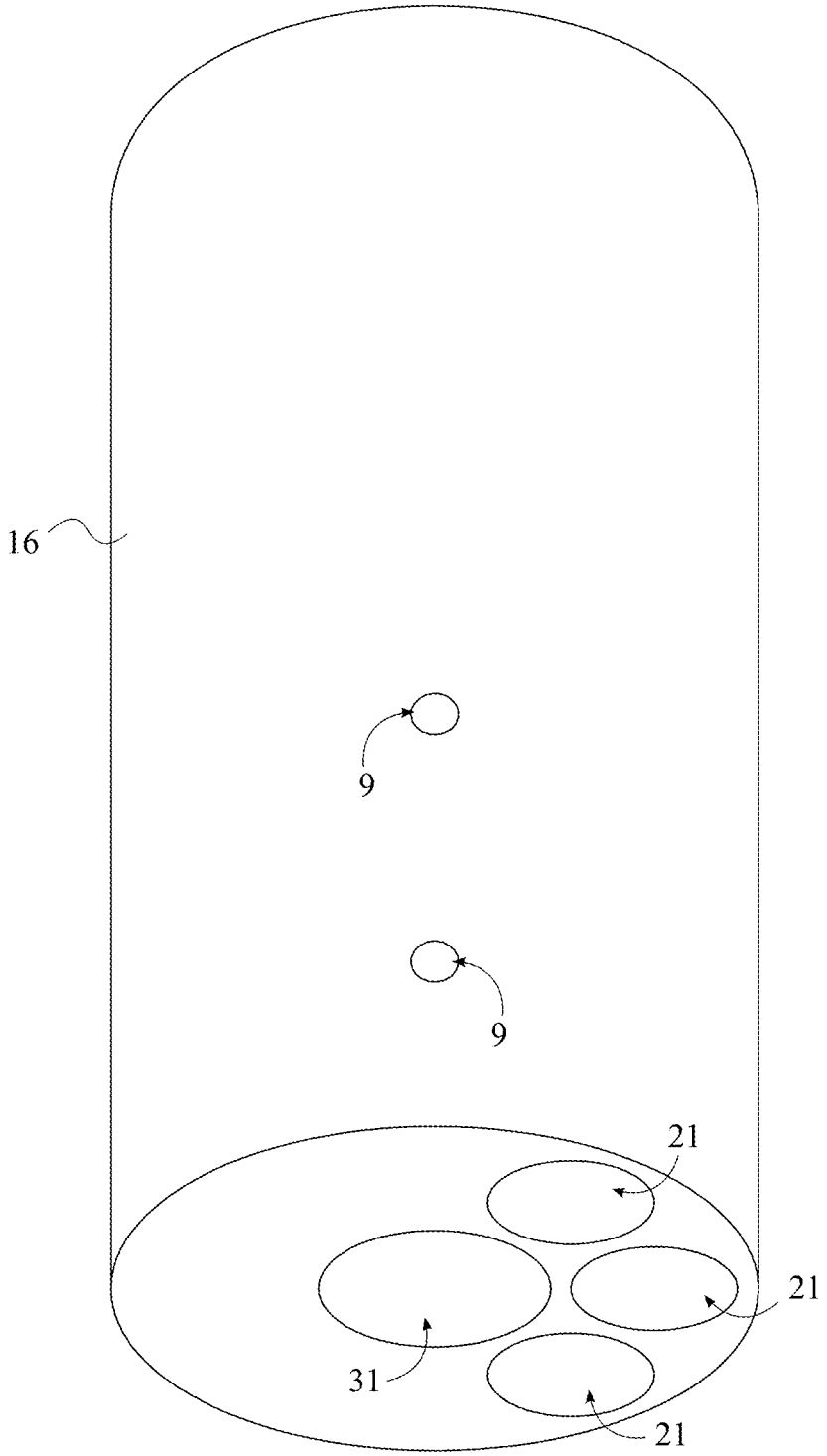
FIG. 9 is a bottom perspective view of the upper balance-weight body in the split-grip option.
Figure 10:
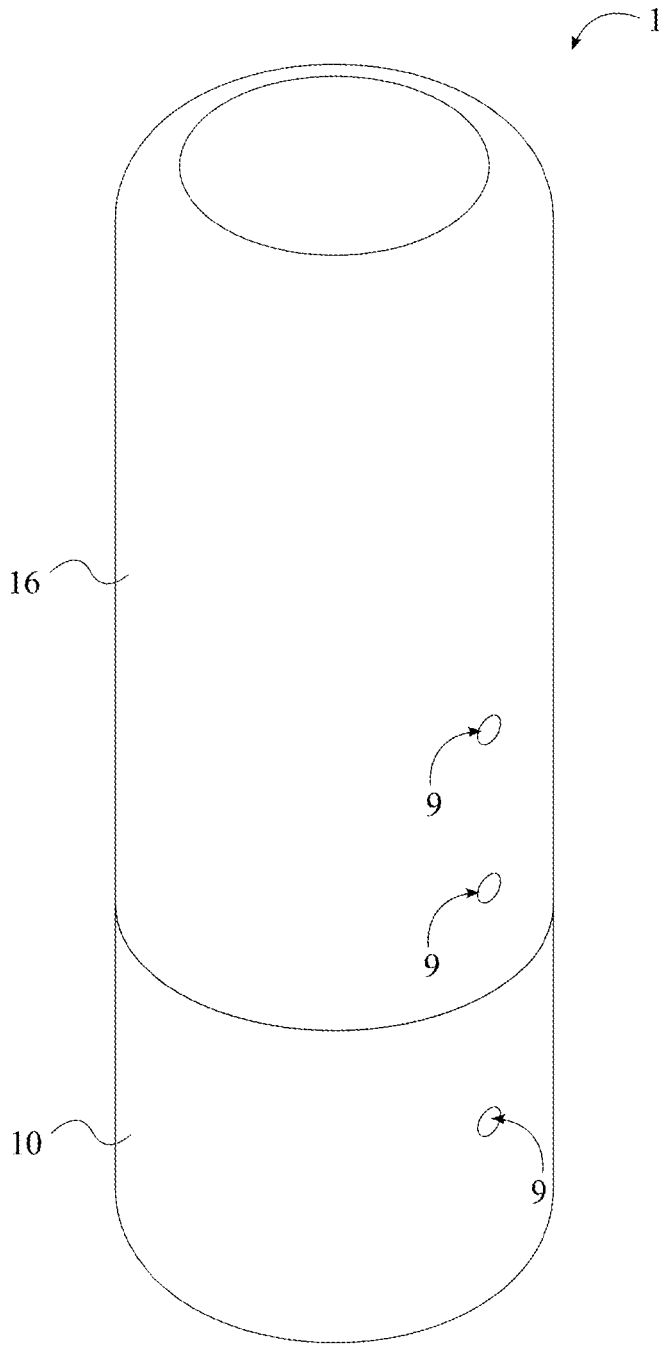
FIG. 10 is a perspective view of the main balance-weight body in the split-grip option; the upper balance-weight body being secured to the lower balance-weight body.
Figure 11:
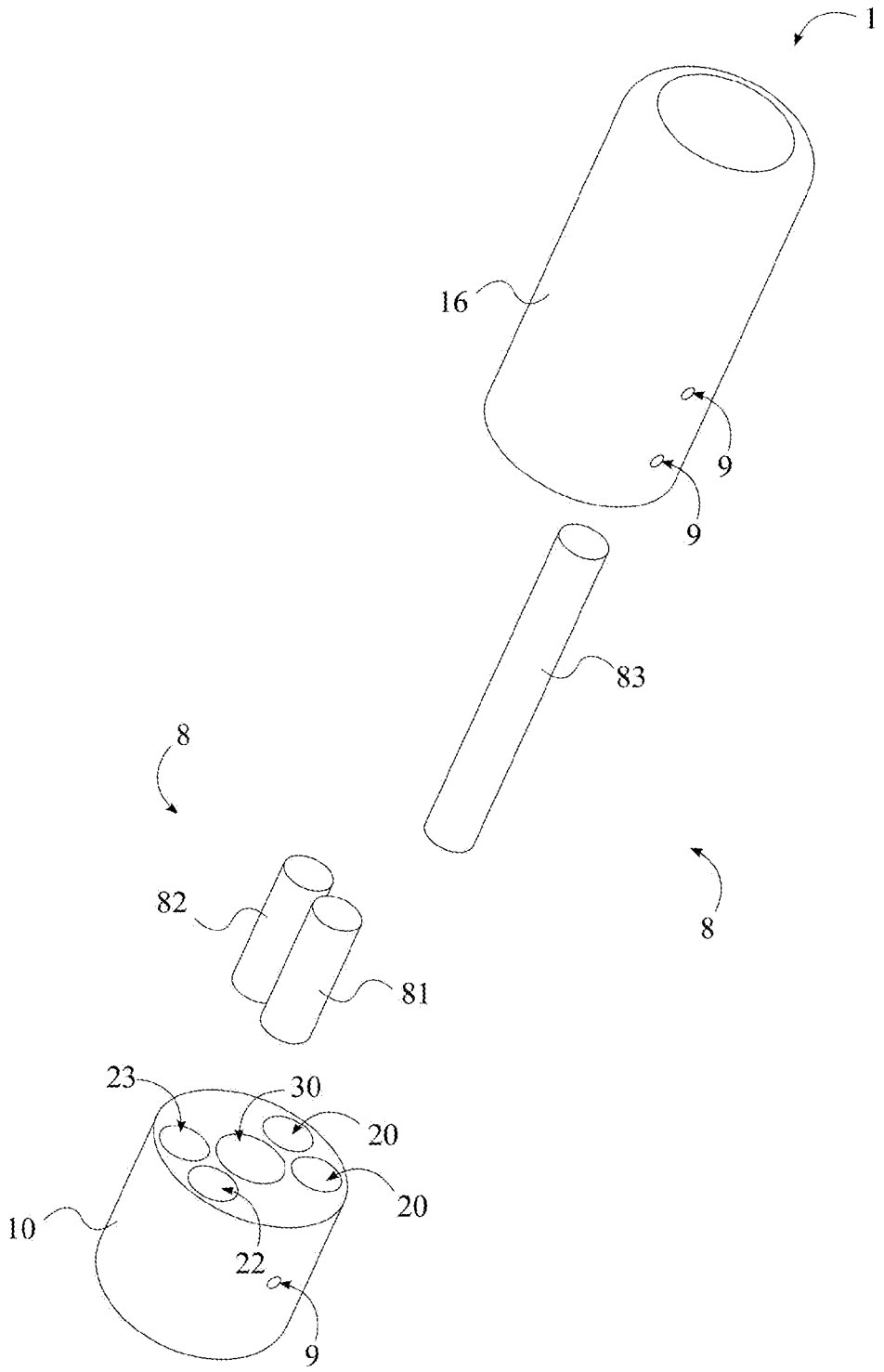
FIG. 11 a top perspective, exploded view of the main balance-weight body and the plurality of internal balancing weights in the split-grip option.
Figure 12:
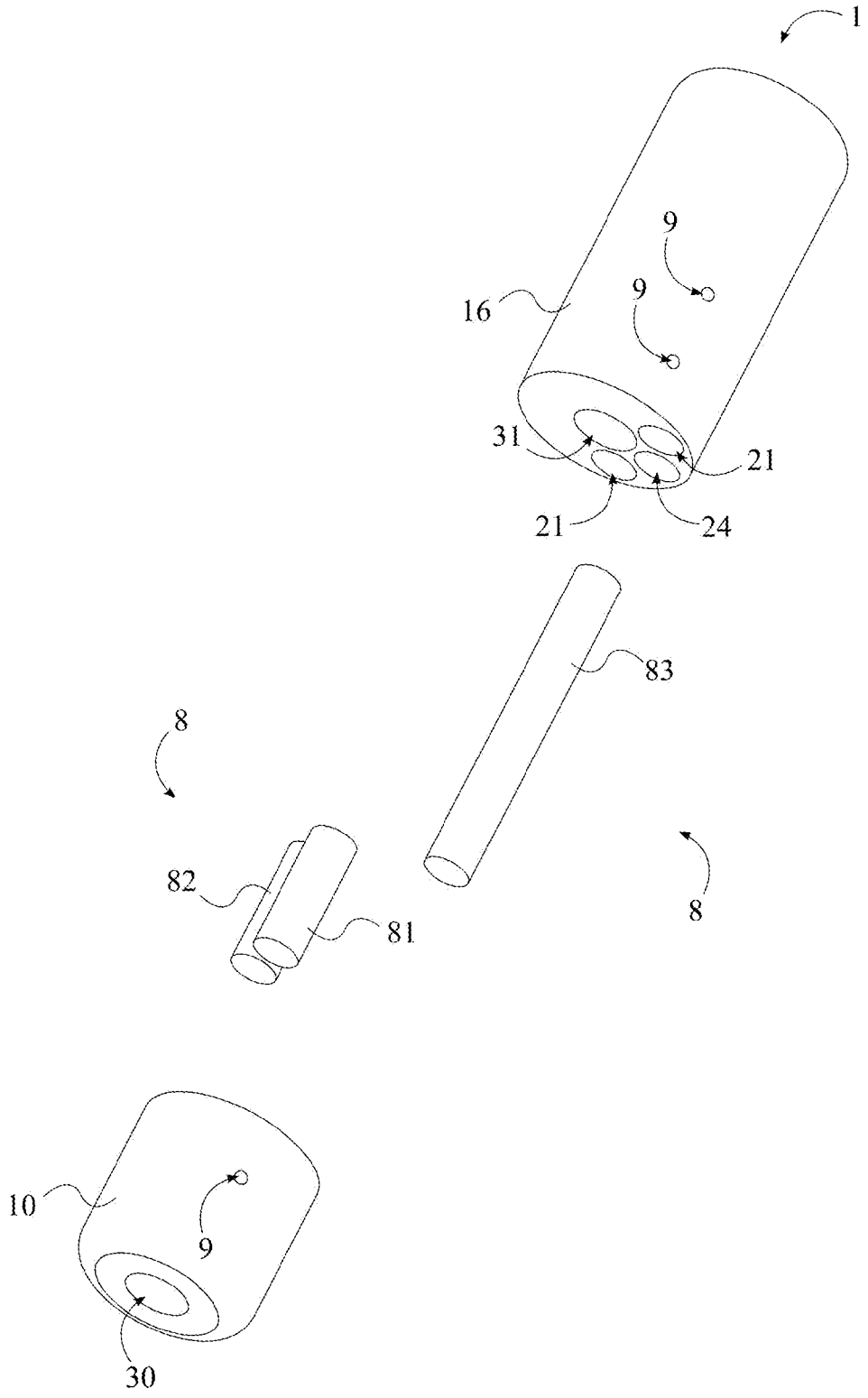
FIG. 12 a bottom perspective, exploded view of the main balance-weight body and the plurality of internal balancing weights in the split-grip option.
Figure 13:
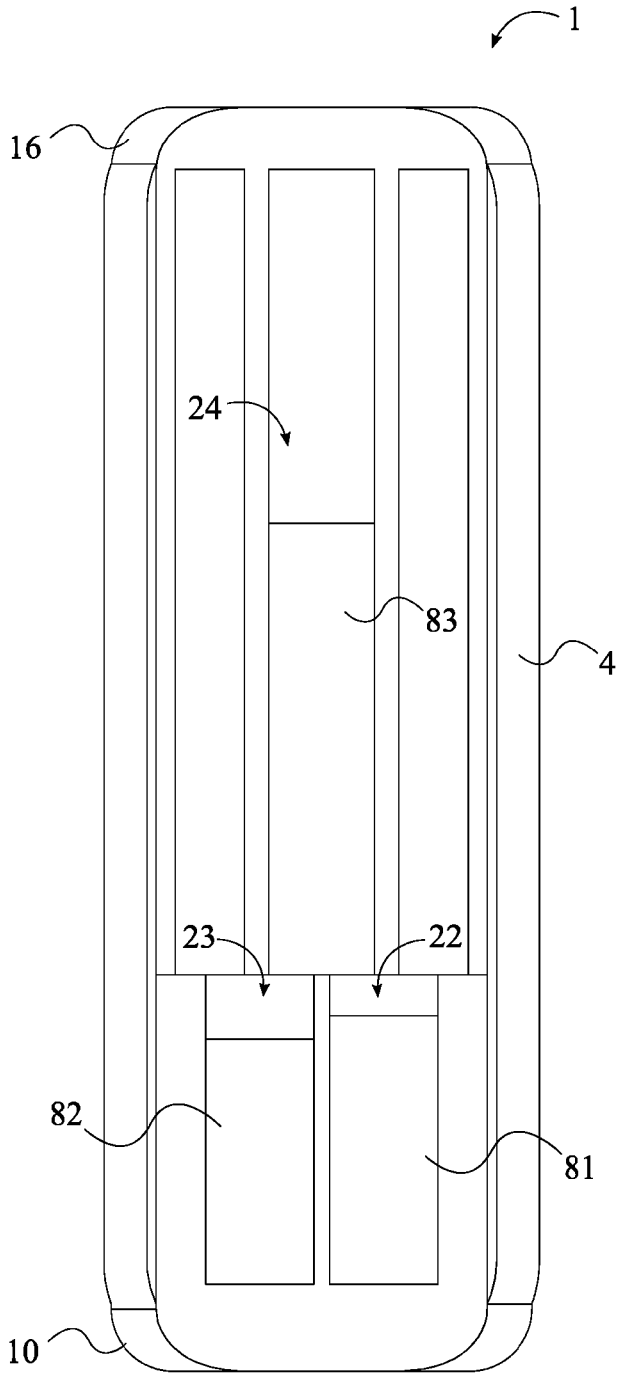
FIG. 13 is a sectional view depicting the plurality of internal balancing weights being positioned in both the plurality of slots and the subsequent plurality of slots, and a grip cover being positioned about the main balance-weight body.
Figure 14:
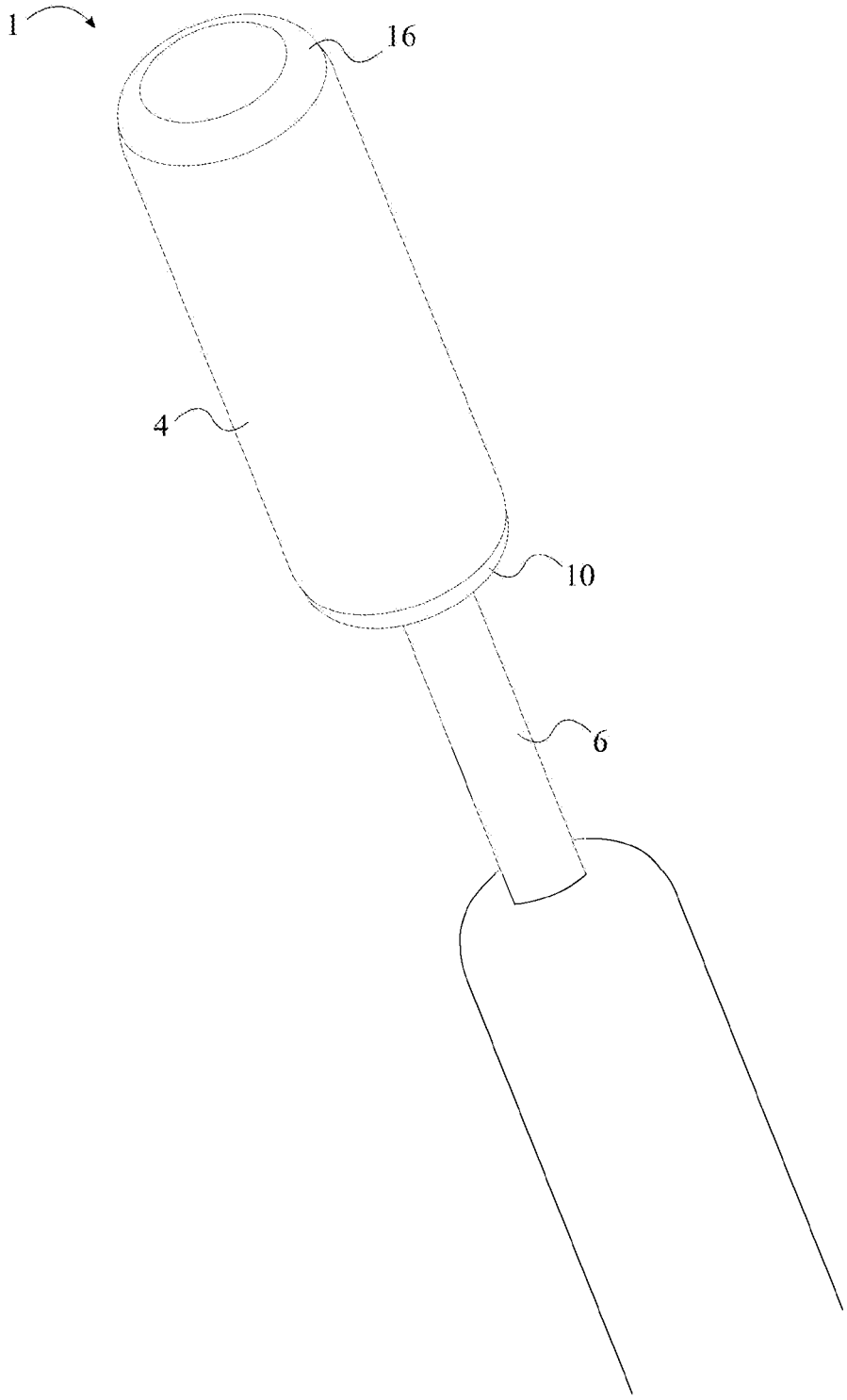
FIG. 14 is a perspective view of the putter shaft being positioned into the shaft receiving channel and the subsequent shaft receiving channel in the split-grip option.

In an alternative embodiment, the present invention is configured in the split-grip option, wherein a subsequent shaft receiving channel 31 traverses into the upper balance-weight body 16 as depicted in FIG. 9. Meanwhile, the shaft receiving channel 30 traverses all the way through the lower balance-weight body 10 as depicted in FIG. 11-12. In this way, when the lower balance-weight body 10 is mounted to the putter shaft 6, the putter shaft 6 is positioned through the lower balance weight body 10 and into the upper balance-weight body 16 as depicted in FIG. 14, and the putter shaft 6 terminates within 1-inch of the end of the upper grip. Furthermore, the upper balance-weight body 16 is configured to retain selected internal balance weights from the plurality of internal balancing weights 8. More specifically, a subsequent plurality of slots 21 traverses into the upper balance-weight body 16 as depicted in FIG. 9. Similar to the plurality of slots 20 traversing into the lower balance-weight body 10, the subsequent plurality of slots 21 is radially dispersed about the upper balance-weight body 16; more specifically, the subsequent plurality of slots 21 is radially dispersed about the subsequent shaft receiving channel 31. Additionally, it is preferable that the subsequent plurality of slots 21 is offset from the plurality of slots 20 as depicted in FIG. 13, when the upper balance-weight body 16 is attached to the lower balance-weight body 10.

The following is an exemplary iteration for balancing the putter in the alternative embodiment, wherein the present invention is featured in the split-grip option. The initial balancing step is to eliminate the lifting moment, which moves the center of gravity of the putter to the centroid of the golfers grip (the target axial balance location). After positioning the lower balance-weight body 10, a first internal weight 81 is selected from the plurality of internal balancing weights 8 and positioned into a specific slot 22 from the plurality of slots 20. The upper balance-weight body 16 is then secured to the lower balance-weight body 10, and the golfer or fitter performs a putting motion one or more times and checks the lifting-moment balance location. The first internal weight 81 is then either left in the specific slot 22 if the target balance position is achieved, moved to a different slot from the plurality of slots 20, or removed completely. An alternative internal balance weight 83 is then selected from the plurality of internal balancing weights 8 and positioned into an explicit slot 24 from the subsequent plurality of slots 21. Again, the upper balance-weight body 16 is secured to the lower balance-weight body 10, and the golfer or fitter performs the putting motion one or more times and checks the lifting moment balance location. The alternative internal balancing weight 83 is then either left in the explicit slot 24 if the target balance position is achieved, moved to another slot from the subsequent plurality of slots 21, or removed completely. Additional internal weights are then added and removed from both the plurality of slots 20 and the subsequent plurality of slots 21 until the desired target lifting-moment balance location is achieved. The process is then repeated to eliminate the torque induced from the putter head, where weights are added to the hole in the front of the grip. Finally the loft-increasing moment is eliminated by additional balancing with additional weight changes. Some iteration is needed between these balance steps to get the lifting, torsion, and loft-increasing balancing all achieved and at the target grip location. Once the balancing operation is completed, each of the selected internal balance weights is adhesively bonded to the main balance-weight body 1.

In one embodiment featuring the split-grip option, the plurality of slots 20 is specifically four holes; two closely spaced sets of holes being diametrically opposed from each other. Meanwhile, the subsequent plurality of holes is specifically three holes that are closely spaced. The number of holes is not important for the basic principles, only for the pragmatic ease of doing the balancing steps. The upper balance-weight body 16 is rotated so that the center hole of the subsequent plurality of slots 21 is aligned with the centroid of the putter head mass for elimination of the torque and moment in the X-Z plane; the offset holes on either side of the center hole being further from the centroid of the putter head. A selected internal weight is positioned into the center hole. If there is too much torque adjustment, then internal weights of desired length and/or mass are used to fill in the offset holes. If more torque adjustment is needed, then the plurality of slots 20 is used; the centroid of the two sets of offset holes being aligned with the centroid of the putter head mass, wherein the offset holes closer to the centroid are unfilled, while the offset holes further away are filled with the desired internal weights. The addition of the torque-resisting internal weights changes the total weight, so the axial location of the main balance-weight body 1 of the present invention may need adjusting from the main grip so the balancing at the target location is achieved. The X-Z plane moment is adjusted by judicial combination of additional rotation of the upper balance-weight body 16 and the torque-resisting insert weights in such a combination that still give the proper torque balancing.

Figure 8:
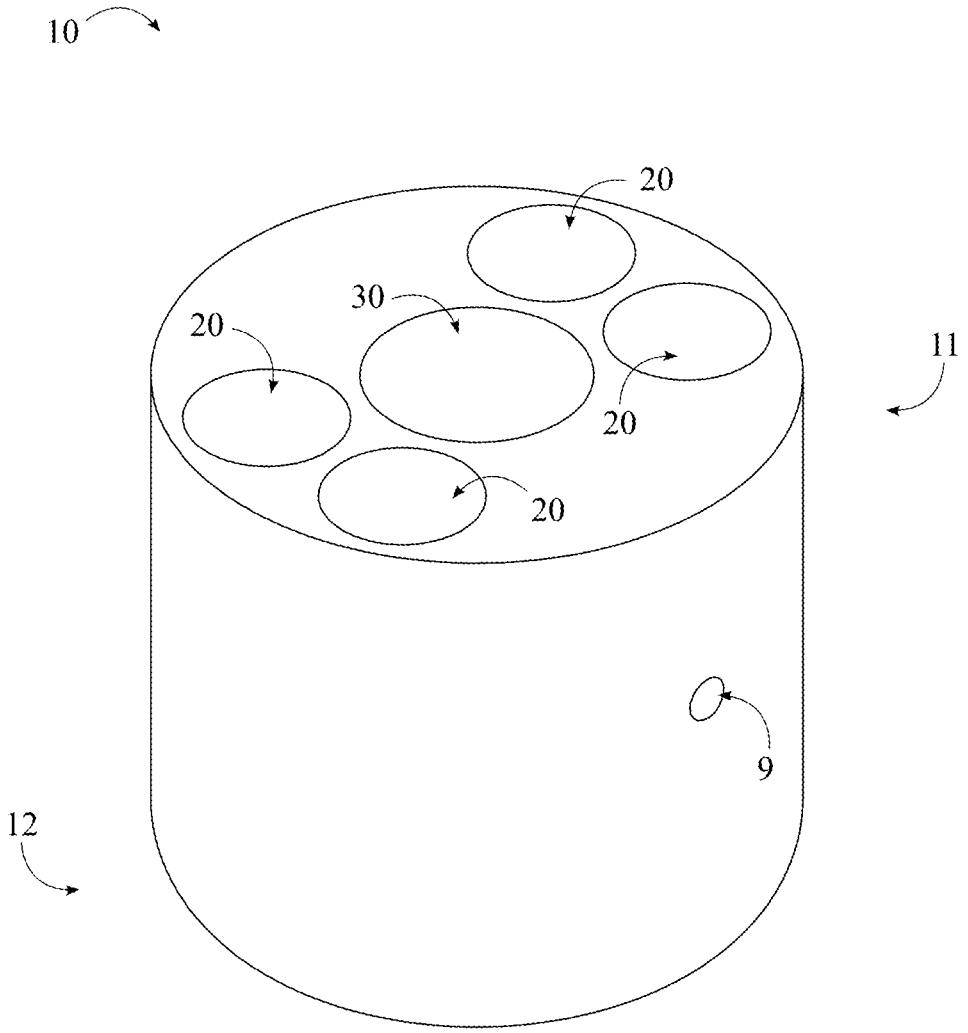
FIG. 8 is a top perspective view of the lower balance-weight body in the split-grip option.

In the alternative embodiment, wherein the present invention is featured in the split-grip option, the main balance-weight body 1 is temporarily secured to the putter shaft 6 via a plurality of set screw holes 9 and a plurality of set screws. In reference to FIG. 8-9, the plurality of set screw holes 9 is dispersed about the lower balance-weight body 10 and the upper balance-weight body 16, wherein the plurality of set screw holes 9 laterally traverses through the lower balance-weight body 10 and the upper balance-weight body 16. To secure the main balance-weight body 1 to the putter shaft 6, the lower balance-weight body 10 is first fitted around the putter shaft 6. Each of the plurality of set screws is then positioned into a corresponding hole from the plurality of set screw holes 9, wherein the plurality of set screws is tightened until each of the plurality of set screws engages with the putter shaft 6 at a location that will give the "lifting moment" balance position at the target grip location. The temporary positioning of the lower balance-weight body 10 along the putter shaft 6 allows the golfer/fitter to adjust and find the ideal radial and axial positioning of the main balance-weight body 1 about the putter shaft 6.

Once the ideal radial and axial positioning of the lower balance-weight body 10 has been found, along with the desired balancing from the plurality of internal balancing weights 8, the lower balance-weight body 10 is permanently secured in placed. An epoxy, or other adhesive, is applied in between the putter shaft 6 and the lower balance-weight body 10 in order to permanently affix the lower balance-weight body 10 to the putter shaft 6. Additionally, the upper balance-weight body 16 is secured to the lower balance-weight body 10 using an epoxy, or other adhesive. Furthermore, the plurality of set screws may be used in addition to the adhesive bond in order to provide an even more secure connection between the main balance-weight body 1 and the putter shaft 6. Once the main balance-weight body 1 has been secured in place, the main balance-weight body 1 is encased by a grip cover 4. The grip cover 4 conceals the plurality of set screw holes 9, and maintains a uniform outer profile of the present invention. Additionally, the grip cover 4 eliminates the feel of the plurality of screw holes and the mating edge along which the upper balance-weight body 16 is mated to the lower balance-weight body 10, ensuring no grip finding indentations are available. When using the split-grip option, the grip indicator is marked on the main grip of the putter, which is located below the main balance-weight body 1.

The following outlines particular dimensions and requirements for the present invention as governed by the rules of the USGA and the Royal & Ancient (R&A) Equipment Standards Division, such that the present invention adheres to professional golf equipment guidelines. While the following dimensions and requirements are outlined below, it is to be known that the present invention can be constructed to any dimensions and standards for use outside of professional golf play. In both the single-grip option and the split-grip option, the outer-most diameter of the present invention should be no more than 1.75 inches (including the grip cover 4). The single-grip option may have a cross section that is circular or circular with an axial flat surface, while the split-grip option must have a cross section that is circular. A slight taper of the diameter along the axial length is acceptable in both the single-grip option and the split-grip option.

The following are provisions for the split-grip option, as outlined by the USGA and R&A. If the total length of the putter is greater than 38.5 inches, then the axial gap between the present invention and the main grip must be at least 1.5 inches. If the total length of the putter is less than 38.5 inches, then the axial gap between the present invention and the main grip must be at least 5 inches. The main balance-weight body 1 must have an axial length greater than 5 inches. When combining the upper balance-weight body 16 with the lower balance-weight body 10, the upper balance-weight body 16 and the lower balance-weight body 10 must mate seamlessly together to avoid any grip finder indentations on the external part of the grip cover 4.

The plurality of internal balancing weights 8 can include any combination of materials with different densities, although the most economical combinations are TP304 stainless steel for the upper balance-weight body 16 and aluminum for the lower balance-weight body 10, which are also corrosive resistant; plain carbon steel has a similar density to TP304 stainless steel and could be used with adequate corrosion protection as well. With the denser stainless steel of the upper balance-weight body 16, balancing in the Y-Z plane is easier to achieve. A nonmetallic material for the lower balance-weight body 10 could also be used if sufficient balancing is obtained with the upper balance-weight body 16 being stainless steel. On occasions with very heavy putter heads, the main balancing-weight body 1 is made entirely of TP304 stainless steel to increase the balancing mass.

While utilizing the plurality of internal balancing weights 8 is ideal for custom balancing an individual putter, this is not the case for mass producing pre-balanced putters. For manufacturing a larger number of identical putters, the plurality of slots 20 could be drilled into the main balance-weight body 1 for each putter in a manner that would require no weights to be added; the main balance-weight body 1 providing the one and only counter weight mass. Each of the plurality of slots 20 could have different dimensions and locations within the main balance-weight body 1, such that no weights need to be inserted. In this way, the putters are balanced to pre-set standards as opposed to the individual golfer.

However, the plurality of internal balancing weights 8 would be utilized with a control putter in order to determine the parameters of each of the slots 20 for the mass produced pre-balanced putters. For producing larger quantities of identical balance grips, one would first use the inserted internal weight procedure as described above with the control putter to determine the desired balance moment. The plurality of slots 20 for the control putter are drilled to full length as described above, allowing for the full balancing of the control putter. Once the size (length) of the each of the plurality of internal balancing weights 8 is known, the plurality of slots 20 can be drilled into the main balance-weight body 1 of each pre-balanced putter at the desired depth so that the balancing is achieved without the plurality of internal balancing weights. For example, if balancing is achieved by inserting a single 1 inch weight into a 2 inch slot, and assuming the weight is the same material as the main balance-weight body 1, then a 1 inch long slot can be drilled at the same location and with the same diameter as the weight in order to achieve the same balancing for each of the pre-balanced putters.

In most cases a total mass between 400 and 1,200 grams is needed for the present invention in order to fully balance the putter. The present invention allows for such a total mass as compared to internally weighted putter shafts with which such a total mass is not possible (even if depleted uranium was used as a weight inside the putter shaft 6, the weight would be about $1/8^{th}$ of what is really needed for complete balancing in just the Z-Y plane; without any torsional balancing or loft-increasing moment corrections). However, it is possible for the present invention to be utilized in conjunction with an internally weighted putter shaft.

Although the invention has been explained in relation to its preferred embodiment, it is to be understood that many other possible modifications and variations can be made without departing from the spirit and scope of the invention as hereinafter claimed.

What is claimed is:

1. A counter-balance grip system for a golf putter allowing for balancing in the key three degrees-of-freedom of motion and balancing of the associated moments and torsion at the centroid of a golfer's grip in the lie-position comprises:

a main balance-weight body;

a plurality of slots;

a shaft receiving channel;

the main balance-weight body comprising a lower balance-weight body and an upper balance-weight body;

the lower balance-weight body having a first terminal end and a second terminal end;

the plurality of slots traversing into the lower balance-weight body through the first terminal end;

the shaft receiving channel traversing into the lower balance-weight body through the second terminal end;

the shaft receiving channel being concentric with the lower balance-weight body;

the upper balance-weight body being attached to the lower balance-weight body about the first terminal end;

the upper balance-weight body being concentric with the lower balance-weight body;

a shaft extender;

an extender channel;

the extender channel concentrically traversing into the lower balance-weight body from the shaft receiving channel so as to form a lip in between the extender channel and the shaft receiving channel;

the shaft extender being positioned within the extender channel and the shaft receiving channel;

the shaft extender comprising an end and a rod;

the end and the rod being connected to each other;

the end being positioned within the shaft receiving channel;

the rod being positioned within the extender channel;

the end comprising an end diameter;

the rod comprising a constant rod diameter;

the end diameter being larger than the constant rod diameter so as to form a flange in between the end and the rod; and the flange being configured to contact against the lip.

2. The counter-balance grip system as claimed in claim 1 comprises:

the lower balance-weight body comprising an upper body section and a lower body section;

the lower body section having a diameter being smaller than a diameter of the upper body section;

the plurality of slots traversing through the upper body section and into the lower body section; and the shaft receiving channel traversing into the lower body section.

3. The counter-balance grip system as claimed in claim 2 comprises:

a grip cover; and the grip cover encasing the lower body section.

4. The counter-balance grip system as claimed in claim 1 comprises:

a threaded channel; and the threaded channel concentrically traversing into the first terminal end.

5. The counter-balance grip system as claimed in claim 4 comprises:

the plurality of slots being radially dispersed about the threaded channel.

6. The counter-balance grip system as claimed in claim 4 comprises:

a screw hole;

the screw hole concentrically traversing through the upper balance-weight body; and the screw hole being concentrically aligned with the threaded channel.

7. The counter-balance grip system as claimed in claim 6 comprises:

a lock screw; and the lock screw being positioned through the screw hole, into the threaded channel.

8. The counter-balance grip system as claimed in claim 1 comprises:

a putter shaft; and the putter shaft being positioned into the shaft receiving channel.

9. The counter-balance grip system as claimed in claim 1 comprises:

a putter shaft;

the putter shaft being positioned into the shaft receiving channel;

the shaft extender being positioned into the putter shaft; and the shaft extender being terminally connected to the putter shaft.

10. The counter-balance grip system as claimed in claim 1 comprises:

the end being tapered away from the rod.

11. The counter-balance grip system as claimed in claim 1 comprises:

a putter shaft;

the putter shaft being positioned into the shaft receiving channel; and the end being positioned into the putter shaft; and the end being terminally connected to the putter shaft.

12. The counter-balance grip system as claimed in claim 1 comprises:

a first internal weight;

the first internal weight being positioned into a specific slot from the plurality of slots; and the upper balance-weight body retaining the first internal weight within the specific slot.

13. The counter-balance grip system as claimed in claim 12 comprises:

a second internal weight;

the second internal weight being positioned into a subsequent slot from the plurality of slots; and the upper balance-weight body retaining the second internal weight within the subsequent slot.

14. The counter-balance grip system as claimed in claim 1 comprises:

a grip cover; and the grip cover encasing the main balance-weight body.

* * * * *